US006470948B2

(12) United States Patent
Yates et al.

(10) Patent No.: US 6,470,948 B2
(45) Date of Patent: Oct. 29, 2002

(54) SAFETY GATE

(76) Inventors: Robert Yates, 16 Vicar Road, Anfield, Liverpool, L6 OBW (GB); Pauline Diane Yates, 16 Vicar Road, Anfield, Liverpool, L6 OBW (GB)

( * ) Notice: Subject to any disclaimer, the term of this patent is extended or adjusted under 35 U.S.C. 154(b) by 0 days.

(21) Appl. No.: 09/785,896

(22) Filed: Feb. 16, 2001

(65) Prior Publication Data

US 2001/0015266 A1 Aug. 23, 2001

(30) Foreign Application Priority Data

Feb. 19, 2000 (GB) ..... 0003849

(51) Int. Cl.[7] ..... E06B 3/94
(52) U.S. Cl. ..... 160/35; 160/84.06
(58) Field of Search ..... 160/84.06, 84.01, 160/84.04, 32, 35, 33, 84.02, 84.03

(56) References Cited

U.S. PATENT DOCUMENTS 4,202,395 A * 5/1980 Heck et al. ..... 160/84.06
4,712,598 A * 12/1987 Bonacci et al. ..... 160/84.06
5,456,303 A * 10/1995 Horinouchi ..... 160/84.06 X
5,531,258 A 7/1996 Poulson et al. ..... 160/376
5,636,679 A 6/1997 Miller et al. ..... 160/317

FOREIGN PATENT DOCUMENTS

| | | |
|---|---|---|
| GB | 1184640 | 3/1970 |
| GB | 2192657 | 1/1988 |
| GB | 2249576 | 5/1992 |

* cited by examiner

*Primary Examiner*—David M. Purol
(74) *Attorney, Agent, or Firm*—Christie, Parker & Hale LLP

(57) ABSTRACT

A collapsable, child, safety gate for selectively forming a barrier across an opening inside a house such as a stairwell, including a storage housing capable of being fixed in position across the house opening, either permanently or temporarily, and a folding curtain-which can be stored in the storage housing when folded and which can be withdrawn therefrom along guide tracks to an extended position for forming a barrier across the opening.

30 Claims, 11 Drawing Sheets

SAFETY GATE

CROSS-REFERENCES TO RELATED APPLICATIONS

This application claims priority of United Kingdom patent application number 0003849.7, filed Feb. 19, 2000.

STATEMENT REGARDING FEDERALLY SPONSORED RESEARCH OR DEVELOPMENT

Not Applicable

BACKGROUND OF THE INVENTION

1. Field of the Invention

The present invention relates to a safety gate, especially a child safety gate, for forming a barrier across an opening inside a house such as a doorway, stairwell, and the like.

2. Description of the Related Art

Child safety gates are used for preventing babies and toddlers from reaching parts of the house which are dangerous to the child (e.g. stairs) or to which the child might cause harm. Known safety gates produced to date comprise rigid non-collapsable, generally rectangular frames of various types which usually include a series of barrier rods, typically of about 0.5 inch/1.2 cm diameter. These frames have screw fixings at the four comers for enabling the frame to be fixed in position within or across the housing opening, either temporarily or semi-permanently. Since these gates employ a rigid frame, they are cumbersome and not easily stored.

Some gates have been proposed which will fold but these have been awkward and bulky once collapsed.

One such known folding gate has a square frame whose four members are joined by L-shaped corner brackets having wall-bracing members attached thereto. A sheet of material is provided inside the frame attached to each frame member by a plurality of loops. This gate is extremely complex and time-consuming to erect and to collapse.

The present invention aims to mitigate at least some of the problems associated with the known gates, and/or to provide a collapsable gate which is easily assembled and/or erected to a barrier position, and easily collapsed without fuss.

BRIEF SUMMARY OF THE INVENTION

According to the present invention, there is provided a collapsable safety gate for selectively forming a barrier across an opening inside a house, comprising: a storage housing capable of being fixed in position across the house opening, either permanently or temporarily; and a folding curtain which can be stored in the storage housing when folded and which can be withdrawn therefrom along guide tracks to an extended position for forming a barrier across the opening.

Preferably, the safety gate is a child safety gate. The house opening can, for example, be a doorway or stairwell.

The folding curtain has the advantages of being compact when folded and being generally light whilst remaining effective as a barrier, and is very simply unfolded and folded to form and collapse the barrier, respectively. The version with the temporarily fixable storage housing has the advantage that it can easily be inserted into, fixed to and removed from the house opening, and, being light and compact, it is easily portable by parents with a child visiting friends and relatives.

When the curtain is fully extended, it usually occupies only a proportion of the vertical dimension of the house opening. The curtain merely needs to form an operative barrier part-way across the opening in order to be able to hinder the passage of, for example, small children.

Preferably, the curtain is flexible, for example formed from a flexible textile material (for lightness). The curtain is preferably provided with a plurality of generally parallel folds (e.g. permanently pleated folds). These can be arranged to predispose the curtain to fold together in a concertina fashion, for neatness and compactness. Preferably, one end portion (a proximal end portion) of the curtain is attached directly or indirectly (e.g. via a fixed rod) to the storage housing.

Preferably, the gate includes a means for holding a distal portion of the extended curtain in position relative to the storage housing. Advantageously, the curtain-holding means comprises an elongate member, usually rigid and, for example, comprising a rigid housing or plate, to which the distal portion, preferably a distal end portion, of the curtain is directly or indirectly attached, the elongate member being capable of being fixed, permanently or temporarily, in position across the house opening, for example generally parallel to a proximal face or opening of the storage housing.

More preferably, the storage housing and/or (if present) said elongate member of the curtain-holding means comprise a means for exerting pressure against a boundary of the house opening, the pressure-exerting means being movable from (a) a retracted position proximal to or inside the storage housing and/or elongate member to (b) an extended position distal from the housing and/or member in which the pressure-exerting means can be biassed towards and/or locked against the house opening boundary. This provides a selectively removable fixing mechanism for e.g. a portable safety gate.

Still more preferably, the pressure-exerting means of the storage housing and/or the elongate member (if present) comprises an elongate tube fixed to or part of the storage housing and/or elongate member, and first and second elongate rods movably mounted inside the tube and projecting from first and second ends thereof, the first and second rods being capable of being biassed towards and/or locked against the house opening boundary. Preferably, the first and/or second rods bear a laterally enlarged pressure-exerting member (e.g. a pressure plate) at ends distal from the tube.

In an especially preferred embodiment, the safety gate comprises: first and second elongate guide tracks adapted to be located at or adjacent respective first and second portions of the curtain, preferably side portions thereof and means for coupling the first and second side portions of the curtain to the respective first and second guide tracks for movement therealong. In use of the gate, the guide tracks are themselves arranged to be located at or adjacent a boundary of the housing opening. This preferred embodiment has the advantage that, for example, the first and second side portions of the curtain can be held in place near the doorway/stairwell frame by the guide tracks, thereby inhibiting children from circumventing the erected barrier by squeezing between the side of the flexible curtain and the door frame, while still allowing the curtain to move between the folded and the extended positions.

The term "elongate guide track" is to be construed broadly as a member to which the respective curtain portion can be directly or indirectly attached or engaged and which is adapted to guide the movement of the respective curtain portion generally along the length thereof.

For a portable gate, the first and/or second guide tracks can be removably fitted into a retaining means, such as a moulded bracket, in the storage housing and/or (if present) in the elongate member of the curtain-holding means. These allow the guide tracks to be held in the assembled position.

Preferably, the first and/or second guide tracks have a longitudinal slot allowing access to a hollow interior of greater width than the slot, and the attachment means comprises a shaft or other projection extending from the curtain and capable of passing through and moving along the slot, the shaft or other projection having an enlarged head (e.g. a T-piece) distal from the curtain of greater width than the slot and capable of being retained within and movable along the hollow track interior. The enlarged head cannot exit the slot and thereby the curtain sides are held next to the guide tracks during expanding/collapsing of the curtain. In a portable version, where the guide tracks are removable relative to the curtain and/or the storage housing, the slotted guide tracks can have an open end through which the enlarged head can pass to be captured by the track Preferably, the attachment means shaft extends from the first to the second guide track when the guide tracks are in the assembled position (e.g. extending across the width of the curtain and/or extending generally parallel to any curtain folds) and bears first and second enlarged heads at opposing ends for retention by the first and second guide tracks, respectively.

Preferably, the gate is such that when the first and/or second guide tracks are in the assembled position they are generally parallel to each other and generally transverse to the storage housing and/or (if present) the elongate member.

Preferably, the safety gate is provided with a plurality (e.g. 3, 4 or more) of spaced-apart means for attaching the first or second curtain portion to its respective guide track. In this way, the curtain portion is held (e.g. by a plurality of shafts spaced apart along the curtain) at a number of positions to the respective guide track, further reducing the likelihood of a child circumventing the erected barrier.

Where guide tracks are present, the elongate member of the curtain-holding means can comprise a rigid rod which extends from the first to the second guide track when the guide tracks are in the assembled position, wherein opposing ends of the rod can be supported in the curtain extended position by supporting portions of the respective guide tracks. More preferably, the guide tracks are slotted (as above) and the rod ends extend in assembled use through the respective slots and into the hollow track interior and can be supported in the curtain-extended position by means of a locking key (e.g. a paddle-shaped key), the key being attached to the track and movable from a position where it does not obstruct movement of the rod along the track to a position where it does obstruct such movement.

BRIEF DESCRIPTION OF THE SEVERAL VIEWS OF THE DRAWINGS

Preferably, the curtain is urged resiliently towards the storage housing. Preferably, the elongate member of the curtain-holding means is adapted to close an opening in the storage housing from which the curtain emerges. These two features respectively help the safety gate to remain in the collapsed configuration and ensure the curtain is conveniently packed away and concealed when collapsed. This is particularly preferable for a safety gate adapted to be permanently fixed to the doorway, stairwell, etc.

The invention will now be further described by way of example only, with reference to the accompanying drawings, in which.

DETAILED DESCRIPTION OF THE INVENTION

Figure 3:
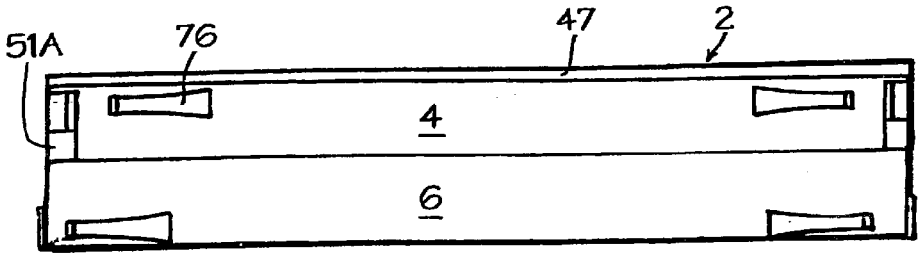
FIG. 3 is a front view of the gate of FIG. 1 when in a collapsed configuration.

FIGS. 1 to 13 illustrate a portable, collapsable child safety gate or safety barrier 2 according to a first embodiment of the invention, comprising an upper elongate housing 4 coupled to a lower elongate housing 6 via an intervening rectangular foldable fabric curtain 8. As described hereinafter, the two housings 4, 6, which are preferably made of metal and/or plastics, can be moved maximally apart with their longitudinal axes substantially parallel until the intervening curtain is taut and/or extended as shown in FIGS. 1 and 2 to create a safety barrier, and can be brought together and into contact along their sides with the curtain folded in between as shown in FIG. 3 in a compact, portable, closed (collapsed) configuration.

It should be noted that references to "upper", "top", "above", "below", "lower", "bottom", "vertical", "horizontal", herein refer to the configuration when the safety gate 2 is arranged vertically with the upper housing 4 uppermost and the lower housing 6 lowermost, but it is not intended to limit the scope of the invention to a gate which operates only in this orientation.

Figure 1:
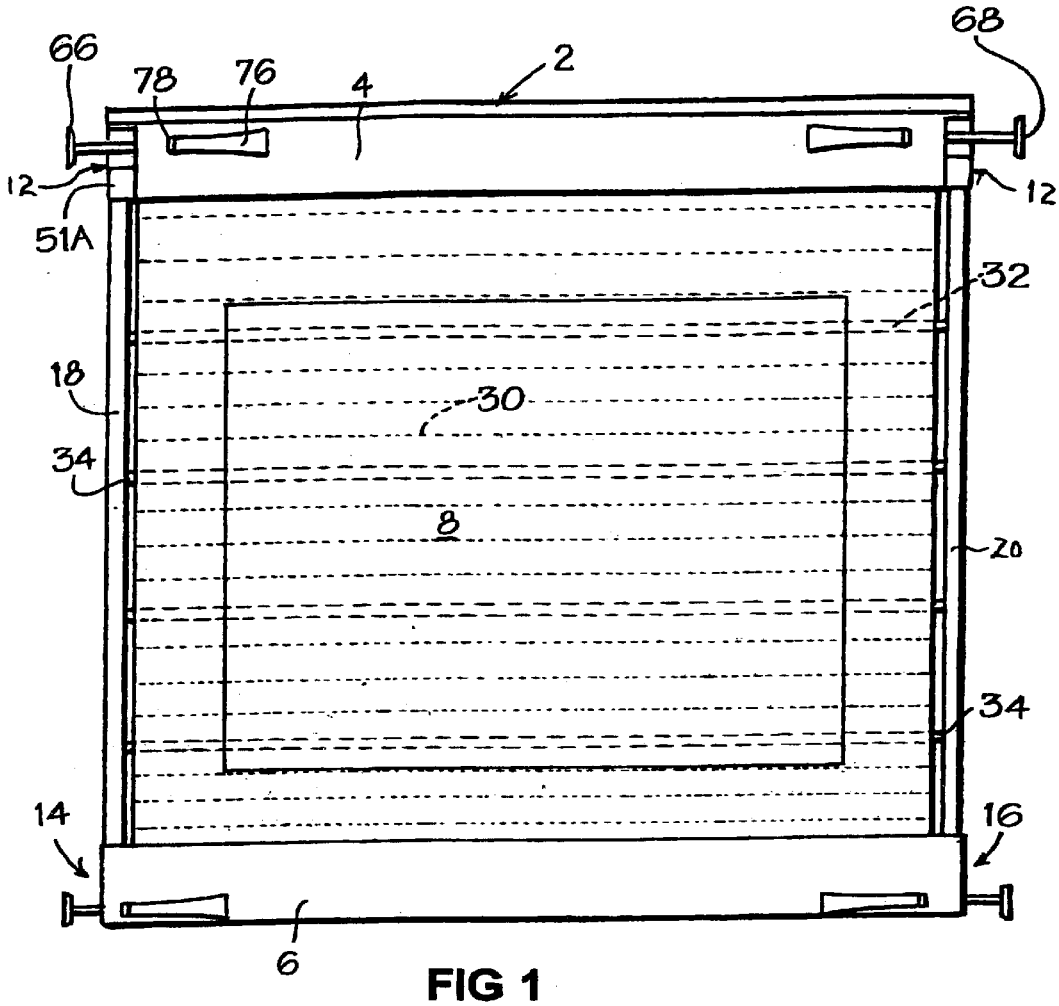
FIG. 1 is a front view of a portable child safety gate according to a first embodiment of the present invention in an extended, operational configuration.
Figure 2:
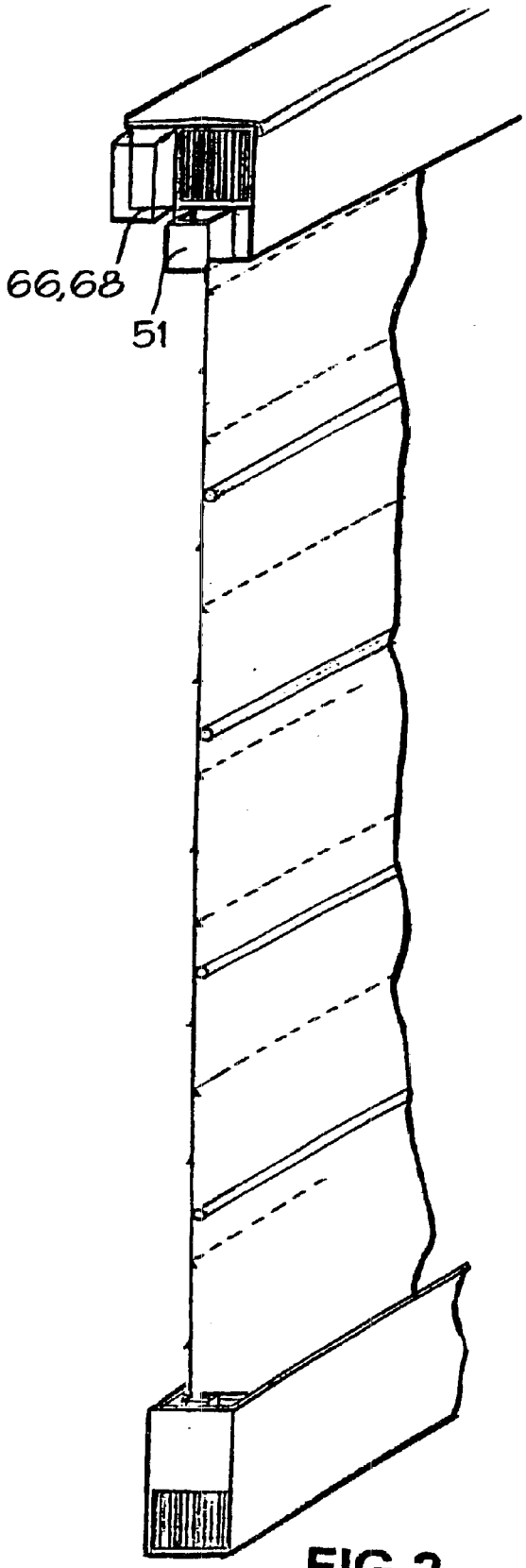
FIG. 2 is a partial perspective view from one side and above of the gate shown in FIG. 1.

To achieve the erected configuration shown in FIGS. 1 and 2, each end 10,12 of the upper housing 4 is arranged to be coupled to a corresponding end 14, 16 of the lower housing 6 by means of a respective removable elongate hollow guide mink 18, 20 extending perpendicularly to both housings 4, 6, so that the two housings and two guide tracks together form a substantially rectangular frame embracing the extended curtain 8.

Figure 4:
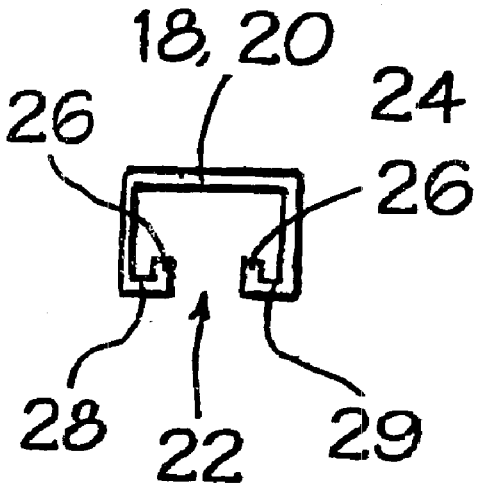
FIG. 4 is a cross-sectional view of a guide track of the FIG. 1 embodiment.

As shown in FIG. 4, each guide track 18,20 is open at both ends and has a longitudinal, centrally-disposed slot 22 along its entire length allowing access to the hollow interior 24 which is of greater width than the slot. Two longitudinal flanges 26 are directed inwardly from walls 28,29 of the guide tracks, with each flange 26 defining a respective one of the two sides of the slot 22. In the assembled configuration, the guide track slots 22 face inwardly towards the curtain 8.

Figure 5:
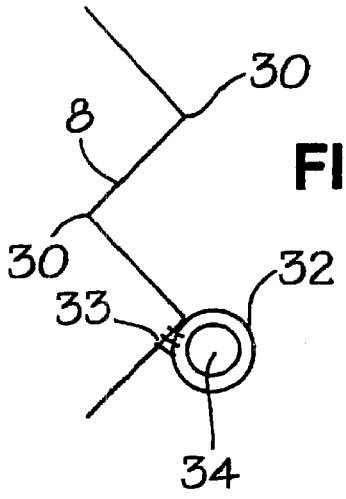
FIG. 5 is a cross-sectional view of a curtain of the first embodiment when partly unfolded.

As shown in FIGS. 1 and 5, the curtain 8 is provided with a plurality of pleated folds 30 extending substantially parallel to the housings 4, 6, each fold 30 being in an opposite direction to the adjacent fold on each side, so that the curtain is adapted to fold together in a concertina fashion. At every fourth fold or thereabouts, there is attached to the curtain a tube of material 32 extending parallel to the folds. The tube 32 is held against an adjacent portion of the curtain by means of a piping stitch 33 (see FIG. 5).

Figure 6:
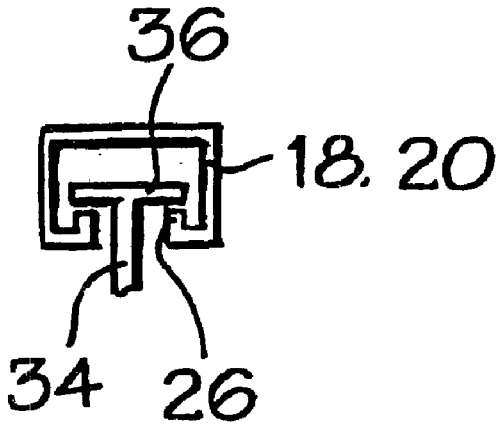
FIG. 6 is as FIG. 4 but including a T-piece rod.

As shown in FIGS. 1, 5 and 6, a rod 34, preferably made of nylon or another semi-flexible plastics material of greater flexibility than steel but less liable to breakage on bending than wood, is disposed along each of the curtain tubes 32, each end of each rod 34 protruding from its respective tube end and comprising a laterally extending integrally formed (eg. moulded) T-piece 36. The rod T-pieces 36 (eg, of nylon) are adapted to be housed (and in the assembled configuration are housed) inside and are moveable along the hollow interior of the guide tracks 18, 20, with each rod axis projecting substantially perpendicularly from the guide track slots 22, and with each T-piece 36 retained by the flanges 26 inside the hollow tracks 18, 20 (the dimension of each T-piece 36 transverse to the rod axis being more that the width of the track slot 22).

Figure 7:
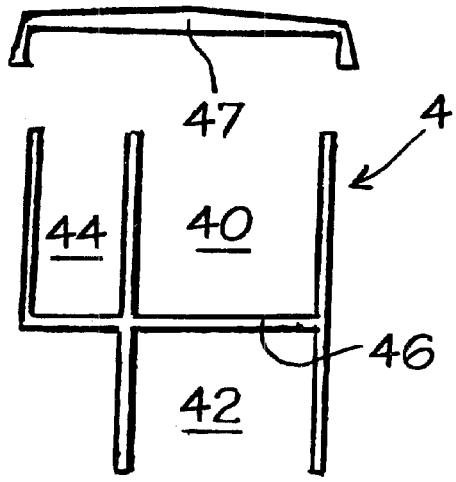
FIG. 7 is a cross-section along line B—B' of FIG. 9 showing an upper housing of the first embodiment.
Figure 12:
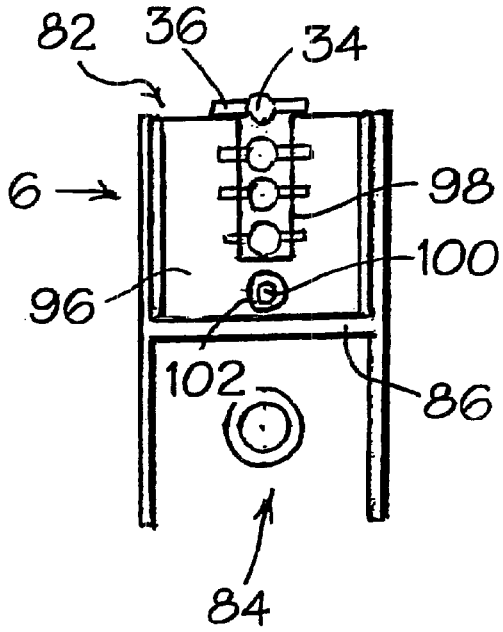
FIG. 12 is a cross-sectional view of the lower housing along line A—A of FIG. 11.
Figure 8:
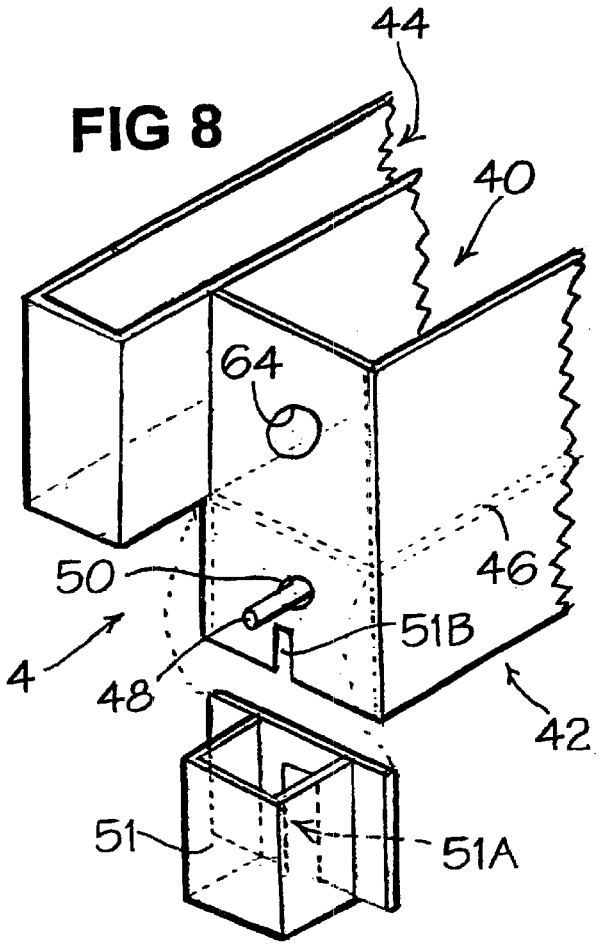
FIG. 8 is a top perspective view of one end of the upper housing of FIG. 7.
Figure 9:
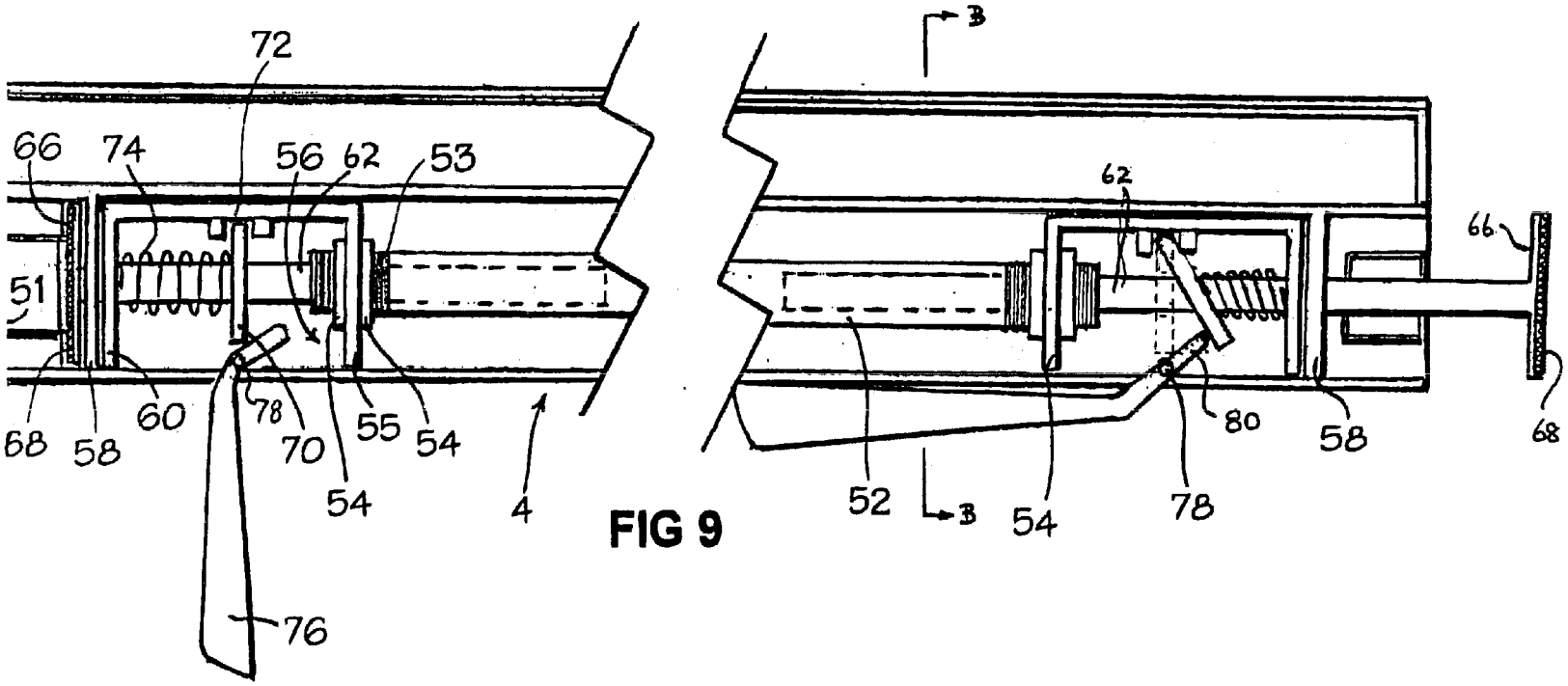
FIG. 9 is a top plan view of the upper housing of FIG. 7.

As shown in FIGS. 7 to 9, the upper housing 4 comprises three compartments 40, 42, 44 disposed along its length. Vertically aligned upper and lower compartments 40,42 are separated by a dividing panel 46 and are open at opposing upper and lower sides respectively (ie. together forming a H-shape in cross-section). A guide track compartment 44 for storage of the guide tracks when the gate 2 is collapsed is attached to the side of the upper compartment 40, and opens upwardly, adjacent to the upper compartment opening. Both ends of the guide track compartment 44 project slightly beyond the respective ends of the upper and lower compartments 40, 42 (see FIG. 8). The upper and lower guide track compartments 40, 44 are closed by a clip-on cover 47.

As shown in FIG. 8, the lower compartment 42 of the upper housing 4 contains a fixed longitudinal rod 48 to which the upper edge of the curtain 8 is attached (and by which it is supported), the rod 48 projecting from and being retained by an aperture 50 in each end wall of the lower compartment 42. The curtain 8 can fold up into the lower compartment 42. A hollow track bracket 51 open at upper and lower ends and whose interior is shaped for receiving the guide track 18, 20 as a sliding fit is injection moulded to the end of the outer face of the lower compartment 42, the fixed rod 48 and the curtain rods 34 when collapsed protruding through generally vertical slots 51 A and 51 B in the bracket and housing into the track bracket 51.

As shown in FIG. 9, the upper compartment 40 of the upper housing 4 contains a mechanism for bracing the child gate against a doorway/stairwell, comprising a longitudinal hollow open-ended metal tube 52 passing through an aperture in a first side portion 55 of an internal metal bracket 56 of open-sided box shape at each end of the upper compartment 40. Outer threaded portions 53 at each end of the tube 52 allow it to be fixed to the first side piece of the bracket 56 by means of two opposing locknuts 54. The bracket 56 acts as a spacer at each end of the compartment 40 between the ends of the tube 52 and the end walls 58 of the compartment 40, with the second (outer) side portion 60 of each bracket 56 abutting the inner surface of the respective end wall 58.

A respective elongate metal (eg. steel) rod 62 (typically about 6.4 mm, 0.25 inch wide) is slidably mounted coaxially within and projecting from each end of the fixed tube 52. Each rod 62 passes through an aperture in the second bracket portion 60 and projects from an aperture 64 (se~ FIG. 8) in the end wall of the upper compartment 40. Outside the upper housing 4, the end of each rod 62 is provided with an enlarged pressure plate 66 having an outer cushion pad 68 for bracing the upper housing 4 against a doorway/stairwell.

Each rod 62 also passes through an aperture (not shown) in a metal locking plate 70 (typically about 3.5mm thick) pivotally attached to a mid-portion 72 of the C-shaped bracket 56. The internal diameter of the aperture of the plate 70 is greater than the external diameter of the rod 62 to a sufficient extent to allow the locking plate 70 to pivot from (a) a resting (unlocked) position generally perpendicular to the rod in which the rod 62 is free to move to (b) a locking position inclined (eg. up to 15° or 30° inclined) from the resting position. In the locked position, the edges of the plate aperture contact the rod 62 locking it against the longitudinal movement. Compression springs 74 urge the locking plates 70 generally towards the resting position. Handles 76 are disposed on the outer side of the upper housing upper compartment 4, each handle rotating about a pivot 78 at or adjacent to the housing wall opposite to the pivotal connection 72 between bracket 56 and locking plate 70. A lever 80 shorter than, inclined to, and fixed to the handle 76 is disposed inside the housing 4 on the other side of pivot 78. Handle 76, pivot 78, and lever 80 together: form a first-class lever, the part 80 of which is adapted to bear on one major face of the locking plate 70 (in FIG. 9, the inner face opposite spring 74) so as to effect pivotal locking movement of the plate 70. Handle 76 is moveable between a position adjacent the housing side in which the plate 70 is inclined into its locking position and a release position remote from the housing side in which plate 70 is generally in its resting (unlocked) position.

The lower housing 6 is illustrated in detail in FIGS. 10 to 13. It is H-shaped in cross-section (see FIG. 12) and is divided into an upper compartment 82 opening upwardly (for holding the curtain 8 when collapsed) and a lower compartment 84 opening downwardly (for holding a mechanism for bracing the safety gate 2 against a doorway/stairwell), divided by a wall 86.

Figure 13:
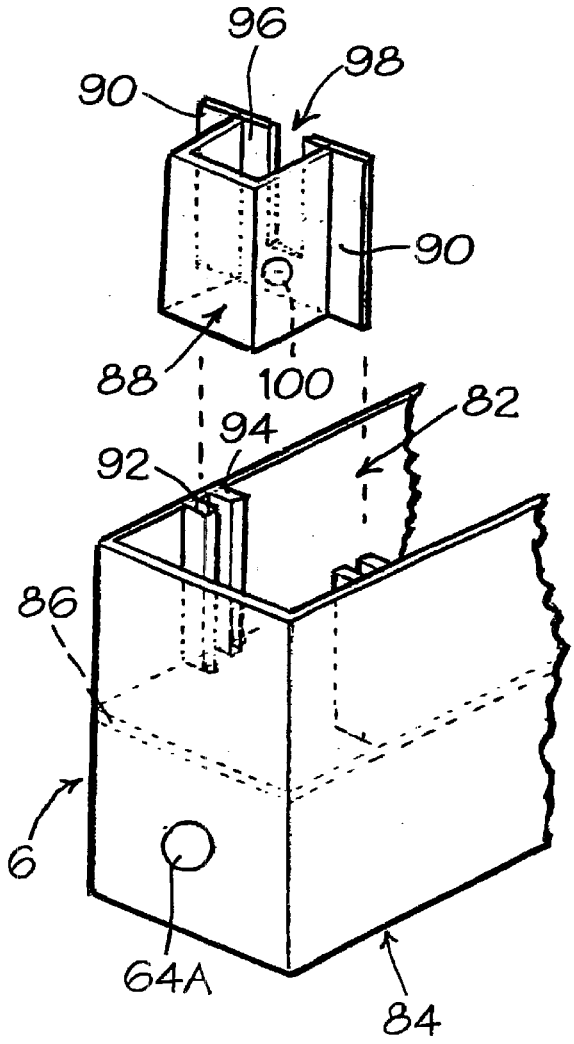
FIG. 13 is a top perspective view of one end of the lower housing of FIG. 10.

At each end and inside the lower housing upper compartment 82 is provided a hollow track bracket 88 open at its upper end and whose hollow interior is shaped for receiving an end of the guide track 18,20 as a sliding fit. The track bracket 88 is either integrally formed (eg moulded) with the lower housing 6 or (as shown in FIG. 13) can be removably attached to the housing 6 by means of flanges 90 which are received by correspondingly-shaped grooves 92 between spurs 94 projecting inwardly from the sides of the lower housing upper compartment 82. The lower housing internal track brackets 88 are vertically aligned with the respective upper housing external track brackets 51, the lower housing 6 being correspondingly longer that the upper housing upper and lower compartments 40 and 42. The side 96 of the track bracket 88 facing inwardly towards the centre of the upper compartment 82 has an upwardly-opening longitudinal (ie. generally vertical) slot 98 adapted to allow the projecting ends of the curtains rods 34 to protrude therethrough into the hollow interior of the track bracket 88 (see FIGS. 12 and 13). Near the closed base of the bracket 88 and below and longitudinally aligned with the slot 98 is provided an aperture 100 in the inwardly-facing side 96 of the bracket 88. The aperture 100 retains in place a fixed rod 102 projecting into the interior of both brackets 88 and disposed along the majority of the length of the upper compartment 82. The lower edge of the curtain 8 is attached to the rod 102 between the two track brackets 88, and the arrangement is such that the curtain 8 can fold up into the lower housing upper compartment 82, with some of the curtain rods 34 lacing held within the compartment 82 and their T-pieces 36 (wider than the slot 98) being held within the bracket 88 (see FIGS. 11 and 12).

Figure 10:
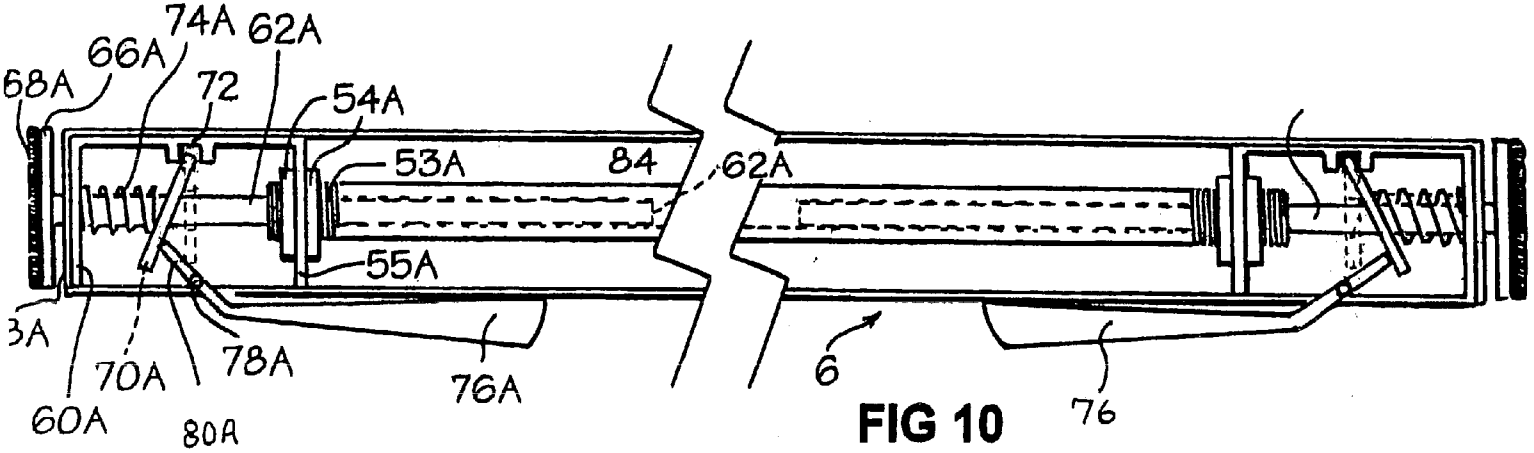
FIG. 10 is a bottom plan view of a lower housing of the first embodiment.
Figure 11:
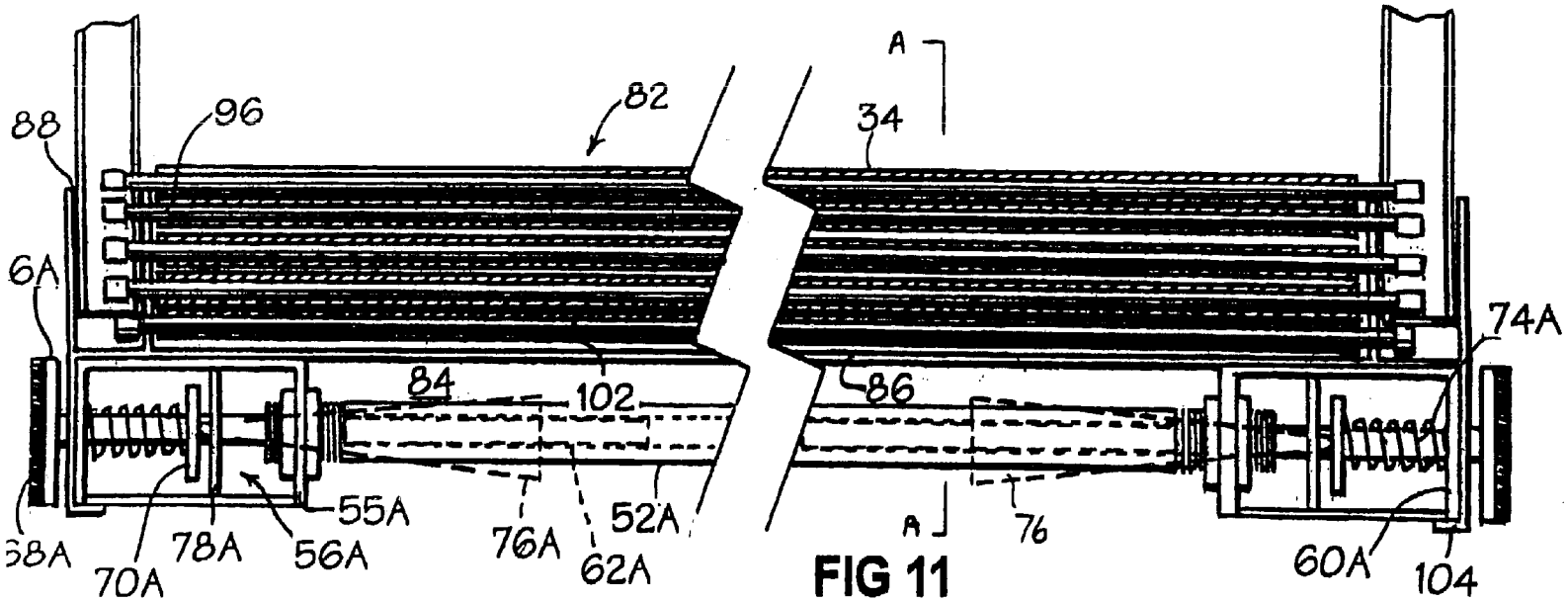
FIG. 11 is a front cross-sectional view of the lower housing shown in FIG. 10, including a curtain and guide tracks.

The interior of the lower compartment 84 of the lower housing 6 is illustrated in FIGS. 10 and 11 and contains a mechanism for bracing the safety gate 2 against a doorway/stairwell which is substantially the same as that contained in the upper housing upper compartment 40, described hereinbefore. The parts illustrated in FIGS. 10 and 11 carry the same numbers as the corresponding parts in the upper housing but with an "A" subscript, for example hollow fixed tube 52A (longer than 52), moveable rods 62A, external pressure plates 66A, handles 76 A, locking plates 70A. The second (outer) side pieces 60A of the open-sided box shaped supporting brackets 56A are supported by an inwardly facing generally horizontal flange/step 104 extending from the lower edge of the lower housing end wall 5*g*A (see FIG. 11).

The child safety gate 2 is opened and installed as follows. Starting from the collapsed configuration shown in FIG. 3 with the upper housing 4 uppermost, the clip-on cover 47 is removed and the two guide tracks 18, 20 are removed from their compartment 44 and arranged vertically above their respective track brackets 51 at either end 10,12 of the upper housing 4, with the track slots 22 facing inwardly. The track ends are pushed from above through the hollow upper track brackets 51 and then into the vertically-aligned lower track brackets 88, so that the curtain rod T-pieces 36 inside the brackets 51, 88 are captured within the interior of the hollow guide tracks 18, 20 and are retained behind the flanges 26 inside the tracks 18, 20 (FIG. 6).

The upper housing 4 is then moved upwardly away from the lower housing 6 to its maximum extent. This causes the curtain 8 to unfold completely to form an operative barber between upper and lower housing 4, 6, with the curtain rod T-pieces 36 sliding upwardly along the inner flanges 26 of the tracks 18, 20. In the fully extended position, the curtain rods 34 are spaced evenly and are retained via T-pieces 36 in the tracks 18, 20 to inhibit a child from circumventing the barrier by passing between the side of the flexible curtain 8 and the tracks 18, 20. Having moved the gate 2 to a position between the doorway/stairwell to be covered, the handles 76, 76A on the upper and lower housings 4, 6 are then moved to their release positions (distal from the housing sides) to unlock the locking plates 70, 70A and the pressure plates 66, 66A are moved outwardly into pressurised abutment with the wall/door frame/stairwell etc. The handles 76, 76A are then moved back against the housing sides to lock the locking plates 70, 70A against the moveable rods 68, 68A and to thereby lock the gate in position in the doorway/stairwell etc.

Collapsing the safety gate 2 is the reverse of the above process.

In this way, the embodiment of FIGS. 1 to 13 provides a collapsable and portable child safety gate which is more compact and more easily carried than existing bulky folding safety gates. It allows a parent with a child to carry the "safety gate easily from home to home when visiting friends and relatives. It will also be of value to child minders. When assembled, the curtain 8 (held in place at its sides by the rod T-pieces 36 retained in the tracks 18, 20) provides a formidable barrier preventing small children from passing.

Figure 14:
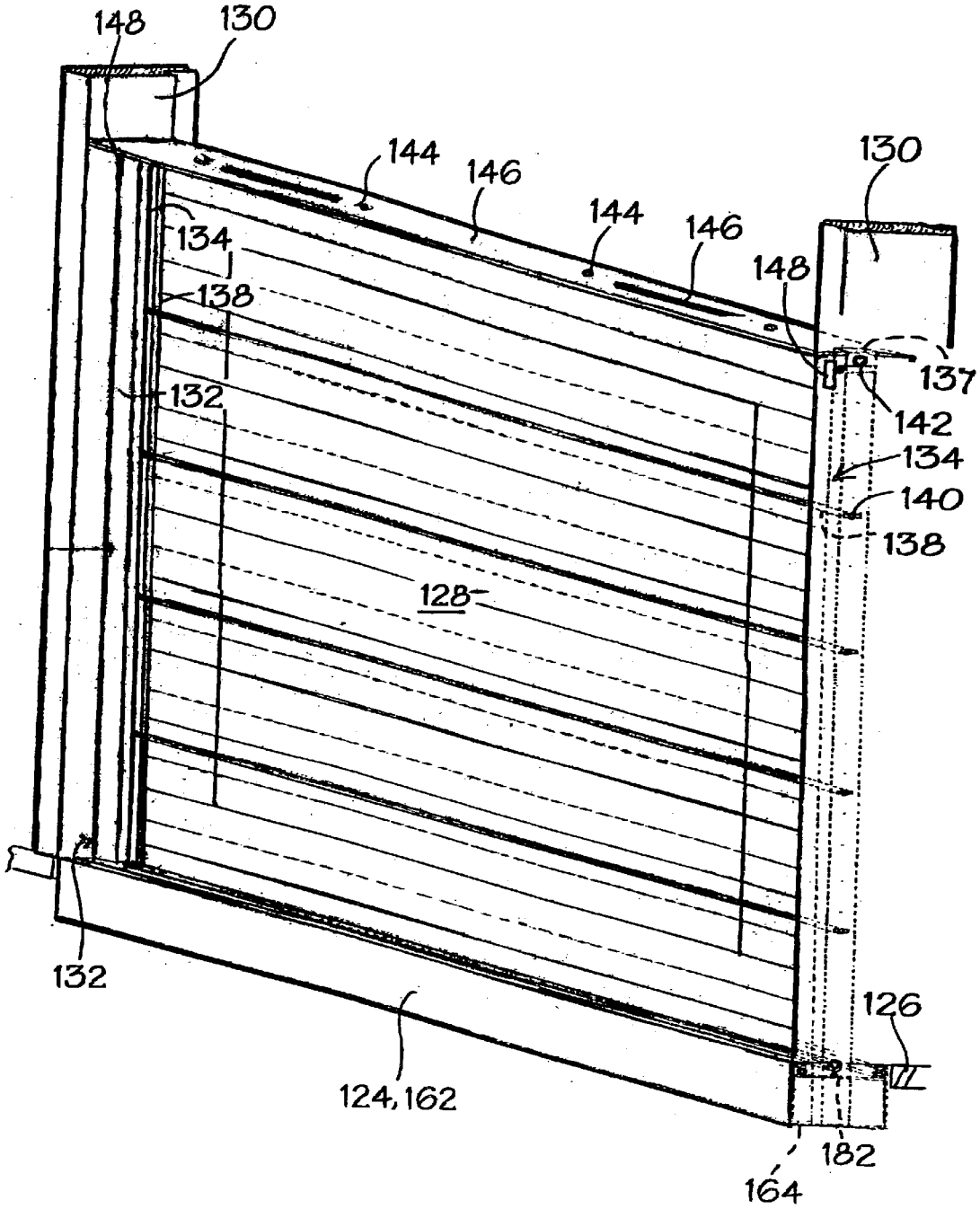
FIG. 14 is a top perspective view of a floor-mounted child safety gate according to a second embodiment of the present invention, in an extended configuration.

FIGS. 14 to 22 illustrate a floor-mounted collapsable child safety gate or safety barrier 120 after installation m a house according to a second embodiment of the invention, comprising an elongate generally horizontal plate 122 coupled along its lower face to one open upper side of a generally horizontal housing 124 fixed to or in the floor 126, the coupling including an intervening rectangular foldable fabric curtain 128. The plate 122 and floor housing 124 are adapted to be disposed permanently across an opening in a house (e.g. doorway or stairwell) and are preferably made of metal and/or plastics. The plate 122 can be moved upwardly to a raised (extended) configuration in which it is maximally apart from and substantially parallel to the housing 124 beneath it, with the intervening curtain taut and/or extended as shown in FIG. 14 to create an operative safety barrier. The plate 122 can be lowered from the raised (extended) configuration to a lowered (collapsed) configuration in which it covers the upper opening of the floor housing 124 to form a "threshold" to the doorway/stairwell etc.

Figure 15:
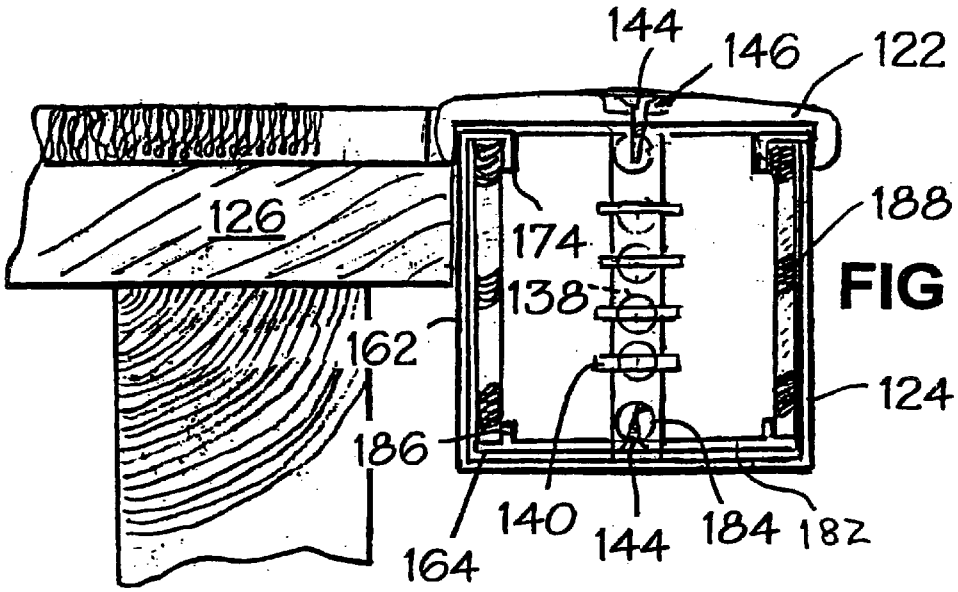
FIG. 15 is a cross-sectional view of a lateral section of a floor housing of the second embodiment.

The floor housing 124 is normally recessed into the floor 126 (see FIG. 15) so that when the threshold plate 122 is lowered it is approximately flush with either the floor boards (not shown) or the floor covering (FIG. 15).

The ends of the floor housing 124 and threshold plate 122 (approximately the same length) are in abutment with or (e.g. for the plate 122) are closely adjacent to the respective side wall or frame 130 of the door/stair opening, to prevent circumvention of the barrier.

Figure 16:
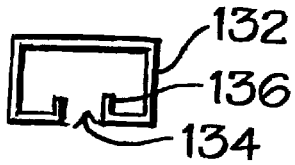
FIG. 16 is a cross-sectional view of a guide track of the second embodiment.
Figure 17:
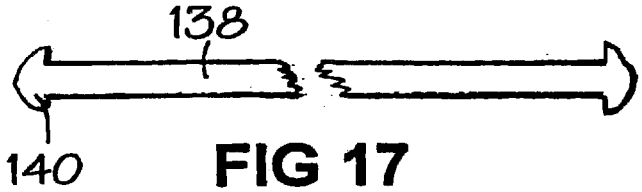
FIG. 17 is a plan view of a curtain rod of the second embodiment.
Figure 18:
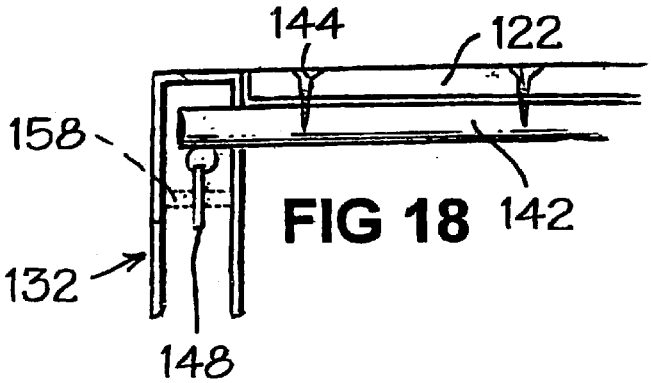
FIG. 18 is a longitudinal cross-sectional view of a threshold plate and guide track of the second embodiment when locked in the extended configuration.
Figure 19:
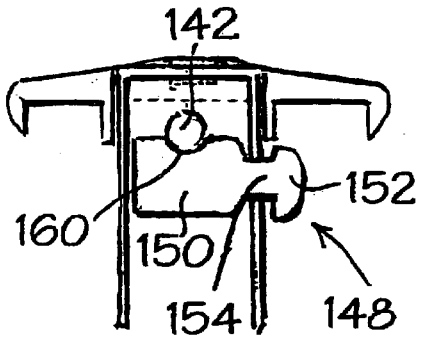
FIG. 19 is a cross-sectional view lateral to the threshold plate of FIG. 18 showing a locking paddle key.
Figure 20:
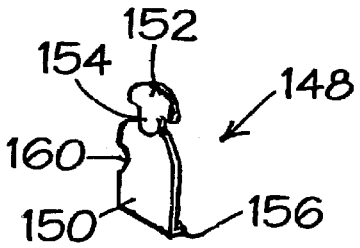
FIG. 20 shows the paddle key in perspective.

A vertical, fixed hollow plastics (e.g. nylon) guide track 132 is fixed to or integrally formed with the frame 130 of the door/stair opening at each end of the housing 124, and can be flush with or project from the frame 130. For example, the guide track 132 can be fixed by countersunk screws to the planar face of the frame 130 (FIG. 14) or can be fixed by screws into a vertical slot in the frame (not shown). As shown in Figs.14 and 16, each guide track 132 has a central vertical slot 134 facing across the opening and has two inwardly-facing flanges 136 defining the sides of the slot 134. Therefore, other than the fact that the top end of the guide track 132 is closed and the track 132 is fixed in place, the construction of the track 132 is similar to the guide tracks 18,20 of safety gate 2.

The ends of the threshold plate 122 have a centre cutaway section in which the tracks 132 (which can project e.g.

about 2 cm from the frame 130) are received. The plate 122 in the raised configuration is generally flush with the upper ends of the tracks 132.

The curtain 128 has the same construction as the curtain 8, holding rods 138 with T-pieces or other enlarged heads 140 at the ends thereof. The rods 138 pass through the track slots 134 and the T-pieces/rod heads 140 are received for vertical sliding movement within the guide tracks 132 behind the flanges 136.

The overall construction and operation of the safety gate 120 is generally therefore similar to those of the safety gate 2 (with threshold plate 122 replacing upper housing 4) except that gate 120 is fixed to the floor after installation and has fixed vertical guide tracks 132 whereas the gate 2 is portable, is selectively/removably fixed in place via pressure plates 66, 66A, and has removable guide tracks 18, 20. Other differences in the construction and operation of safety gate 120 are now described.

The top edge of the curtain 128 is attached to an upper fixed plastics (e.g. nylon) rod 142 (FIGS. 15, 18, 19), which is itself positioned centrally and longitudinally underneath the threshold plate 122 and is fixed thereto by a plurality of downwardly-directed countersunk screws 144 (FIGS. 14, 15, 18) passing through the plate 122 and into the top of the fixed rod 142. The worms of the screws 144 have a plurality of spaced-apart grooves (not shown) parallel to the central screw longitudinal axis, to help cut a thread in the plastics rod 142 and to effect a strong grip therewith.

The top face of the threshold plate 122 is provided with two recessed pull-handles 146 (FIGS. 14, 15, 19) to enable the plate to be raised. Each handle 146 is a plastics-coated metal leaf spring, both ends of which are held slidably within grooves (not shown) inside the plate 122. Finger recesses (not shown) either side of the mid-portion of each handle 146 allow the handle mid-portion to be lifted by hand against the spring-force (the handle ends moving inwardly) to effect movement of the plate 122. Release of the handle 146 leads to it springing back into its recess so that the top edge is flush with the top plate face, to prevent persons tripping over the handles when the gate 120 is lowered.

The upper fixed rod 142 and thus the plate 122 and curtain 128 are supported in the upper open position by means of a substantially planar, paddle-shaped key 148 (FIGS. 18 to 20) mounted adjacent the upper end of each guide track 132, generally perpendicularly to the vertical plane of the gate 120 (defined by curtain 128 and parts 122, 124 and 132 when raised). Each paddle key 148 has an enlarged main portion 150 ("paddle") adapted to be disposed inside the track 132 and an enlarged handle portion 152 outside, separated by a constrained neck portion 154, all parts 150, 152, 154 being generally coplanar. However, the end of the "paddle" portion 150 opposite the handle portion 152 has a flange 156 emending transversely to the paddle key plane. The paddle key 148 is mounted, for rotational motion about its neck 154 and for longitudinal motion (along its central axis including bundle 152, neck 154 and paddle 150), in a generally horizontal slot 158 (FIG. 18) in the upper portion of the track 132 generally parallel to but spaced apart from the main gate vertical plane. The height of the slot 158 is greater than the width of the neck 154, allowing free 360° rotation when the neck is aligned with the slot (FIG. 19), but is less than the length of the transverse flange 156. In this way, when the paddle key 148 is turned so that it is coplanar with the slot 158, it can be withdrawn longitudinally from the slot until flange 156 abuts the inner guide track sides adjacent the slot 158, the flange 156 hindering complete removal of the key 148 from the slot 158. The side of the key paddle portion 150 spaced apart from the central key axis is partially cut away to act as a recessed support 160 for holding the upper fixed rod 142 when the key 148 is vertical beneath the rod.

Figure 22:
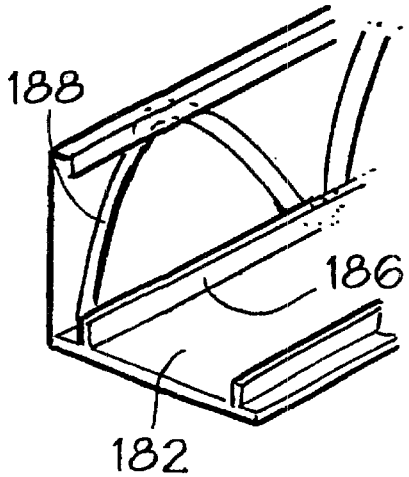
FIG. 22 is a cut-away top perspective view of the floor housing of FIG. 15 showing part of the inside.
Figure 21:
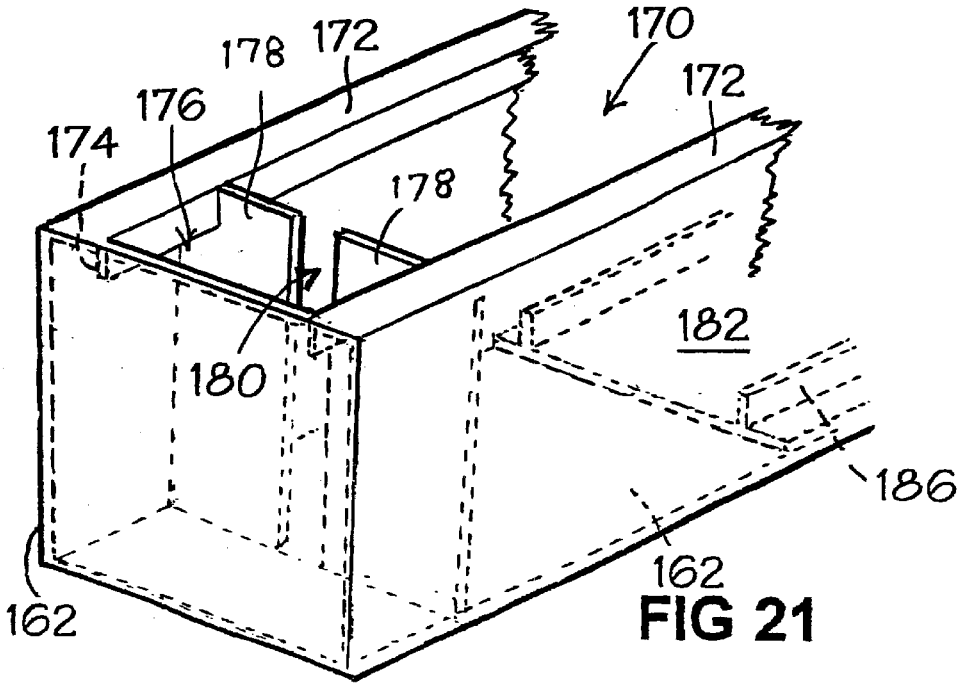
FIG. 21 is a top perspective view of the floor housing of FIG. 15.

As illustrated in FIGS. 15 and 21 and 22, the elongate floor housing 124 has closed sides 162, base 164 and ends but has an upper opening 170 occupying all the length and most of the width of the housing, flanked at either side (width-wise) by longitudinal overhangs which at their inner edges have downwardly-directed flanges 174. Flange 174, overhang 172 and the housing side wall 162 together form an inverted U-shaped enclosure in cross-section.

The housing 124 has a single major compact eat in the middle, and a minor compartment 176 at each end separated from the major compartment by two laterally-extending vertical walls 178 (aligned longitudinally) separated by a vertical upwardly-opening slot 180. The lower end of the respective guide track 132 is fixed inside the minor end compartments with the track slot 134 and the housing slot 180 aligned. The curtain rods 138 pass through both slots and when the gate is collapsed the T-pieces/enlarged rod ends 140 are housed in minor compartments 176 (which therefore acts analogously to track bracket 88 in gate 2).

A horizontal metal or plastics floor plate 182 rests on the base 164 of the housing major compartment (FIGS. 15, 21, 22) and is substantially the same or slightly less width. The plate 182 is fixed via upwardly-directed countersunk screws 144 (as described above) to a central longitudinally-directed plastics (e.g. nylon) lower fixed rod 184 to which is attached the lower edge of curtain 128.

The floor plate 182, whose main function is to prevent debris from collecting inside the housing 24, is provided, adjacent (e.g. 3.5–4 ram away from) but not at its side edges, with upwardly projecting longitudinal retaining flanges 186 running along substantially its whole length. Flange 186, housing side wall 162 and the intervening portion of floor plate 182 together form an upwardly directed retaining enclosure in cross-section.

Along each housing side wall 162 is provided a metal ribbon-like spring 188 shaped substantially as a sine wave (e.g. with ribbon width about 3–3.5 mm and thickness about 1 mm). The upper peaks of the wave-shaped spring 188 are retained within the upper inverted U-shaped enclosure 162, 172, 174 and the lower troughs of the spring are retained within the lower retaining enclosure 162, 182, 186. The upper and lower flanges 174, 186 hold the spring 188 upright.

When the floor plate 182 and the gate 120 are lowered (collapsed), the spring 188 is relatively relaxed and occupies only a proportion of the length of the floor housing 124 (FIG. 22) and the curtain 128 is fully folded within the major housing compartment (FIG. 15). The whole gate is concealed.

In operation, starting from the closed position (FIG. 15), the handles 146 are used to pull the threshold plate 122 and curtain 128 to the fully raised position. The enlarged rod ends 140 run up the guide tracks 132. The paddle key 148 is initially horizontal and fully retracted from the guide track 132 to allow the upper fixed rod 142 to clear it and move above it during raising of the barrier. The paddle key 148 is then moved longitudinally fully into the track 132 below the rod 142 and then turned through 90° to a vertical position, with the recessed rod support 160 of the paddle 150 uppermost directly beneath and supporting the rod 142. The threshold plate 122 and gate 120 is thereby maintained in the raised position.

During raising, the tension in the curtain 128 urges the floor plate 182 upwardly within the housing 124 to a position shown in FIG. 14. In this position, the wave-shaped spring 188 is compressed vertically and therefore is extended horizontally (i.e. in the direction of the central axis of the wave and longitudinally to the housing) to an extended distorted configuration (not shown) in which it occupies most of the length of the housing 124. The tension/compression of the spring in this distorted configuration urges the floor plate 182 downwardly against the curtain tension. Therefore, when the paddle keys are turned and withdrawn to allow the gate 120 to collapse, the threshold plate 122 is urged downwardly into the fully closed position, abutting the floor housing 124. This inhibits the threshold plate 122 from remaining in a marginally raised position just above the floor housing after collapsing of the gate 120, so decreasing the chance of people tripping over an ajar threshold plate 122 when passing through the doorway/stairwell.

The present invention is not limited to the foregoing embodiments.

What is claimed is:

1. A collapsible safety gate for removably forming a barrier across an opening inside a building comprising:

a portable, elongate storage housing having first and second separable housing portions;

a first clamping means connected to the ends of said first housing portion for removably fixing the first housing portion in a horizontal position across said building opening;

a folding curtain having first and second ends connected respectively to said first and second housing portions and movable between a collapsed state and an extended state, wherein when in the collapsed state, the first and second housing portions are disposed adjacent to each other and the curtain is disposed in a folded condition within the housing portions, and when in the expanded state, the first and second housing portions are spaced apart such that the curtain forms a barrier across the building opening;

a plurality of coupling means for coupling the curtain to a first and second elongate guide track, the coupling means disposed at intervals along each of two sides of the flexible curtain;

a socket means connected to each end of said first and second housing portions for receiving at least one curtain coupling means when the curtain is in its collapsed state; and the first and second elongate guide tracks removably connected to said socket means to engage said coupling means when the first and second housing portions are spaced apart, such that said coupling means are slidable along the tracks.

2. A safety gate according to claim 1 wherein each socket means comprises an opening for receiving one of the first and second guide track and a longitudinal slot, and wherein each guide track comprises a longitudinal slot that is vertically aligned with the socket means slot in the first and second housing portions.

3. A safety gate according to claim 2 wherein the slot of each socket means receives at least one coupling means when the curtain is in the collapsed state.

4. A safety gate according to claim 3 wherein each end of said first and second housing portions comprises an opening and each socket means comprises a flange that mates with one of the first and second housing openings to couple each socket means to one of the first and second housing portions.

5. A safety gate according to claim 1 wherein each coupling means comprises an end section and each guide track comprises a first longitudinal slot and second longitudinal slot, wherein the second slots are wider than the first slots and the first and second slots form a channel, such that each end section extends from the curtain and slidably couples to one of the channels when the first and second housing portions are spaced apart.

6. A safety gate according to claim 5 wherein the first and second elongate guide tracks each have an open end through which said end sections are inserted to engage the curtain with the guide tracks and through which the end sections are exited to disengage the curtain from the guide tracks.

7. A safety gate according to claim 5 wherein each coupling means comprises a shaft, the shaft having a first end section and a second end section, such that the first end section of the shaft is slidably coupled to the channel of the first guide track and the second end section of the shaft is slidably connected to the channel of the second guide track when the first and second housing portions are spaced apart.

8. A safety gate according to claim 1 wherein said first clamping means is movable from a retracted position, one of proximal to and inside the first housing portion, to an extended position protruding from the first housing portion, the first clamping means being biased towards a boundary of said building opening.

9. A safety gate according to claim 8, wherein said first clamping means comprises an elongate tube coupled to the first housing portion, the elongate tube having first and second elongate rods movably mounted inside the tube and projecting from first and second ends thereof, and means for biasing said first and second rods towards said building opening boundary.

10. A safety gate according to claim 9 wherein said first and second elongate rods each comprise a laterally enlarged pressure exerting member, remote from said tube, for removably fixing the first housing portion in a horizontal operational position across said building opening.

11. A safety gate according to claim 9 wherein said first clamping means further comprises first and second locking plates, said first and second locking plates incorporating apertures through which said first and second rods respectively pass, the first and second locking plates being pivotally attached to the first housing portion such that each of said first and second locking plates are pivotable from a resting position perpendicular to its respective rod to a locking position angled to its respective rod, such that in the locking position edges of said apertures are forced into contact with their respective rod, locking the respective rod in position.

12. A safety gate according to claim 11 wherein said means for biasing said first and second rods towards said building boundary comprises first and second first-class levers pivotably mounted to the first housing portion, the first and second first-class levers bearing against said first and second locking plates respectively in order to extend said first and second rods towards the building opening boundary and to lock the first and second locking plates against the first and second rods respectively, such that the first and second rods and locked in place.

13. A safety gate according to claim 12 wherein said second housing portion comprises a second clamping means connected to the ends of the second housing portion for removably fixing said second housing portion in a horizontal, operational position across the said building opening.

14. A safety gate according to claim 1 wherein said second housing portion comprises a second clamping means connected to the ends of said second housing portion for removably fixing said second housing portion in a horizontal, operational position across,.the said building opening.

15. A safety gate according to claim 14 wherein said second clamping means is movable from a retracted position, one of proximal to and inside the second housing portion, to an extended position protruding from the second housing portion, the second clamping means being biased towards a boundary of said building opening.

16. A safety gate according to claim 15 wherein said second clamping means comprises an elongate tube coupled to the second housing portion, the elongate tube having first and second elongate reds movably mounted inside the tube and projecting from first and second ends thereof, and means for biasing said first and second rods towards said building opening boundary.

17. A safety gate according to claim 16 wherein the said first and second elongate rods each comprise a laterally enlarged pressure-exerting member, remote from said tube, for removably fixing the second housing portion in a horizontal operational position across said building opening.

18. A safety gate according to claim 16 wherein said second clamping means further comprises first and second locking plates, said first and second locking plates incorporating apertures through which said first and second rods respectively pass, the first and second locking plates being pivotally attached to the second housing portion such that each of said first and second locking plates are pivotable from a resting position perpendicular to its respective rod to a locking position angled to its respective rod, such that in the locking position edges of said aperture are forced into contact with their respective rod, locking the respective rod in position.

19. A safety gate according to claim 18 wherein said means for biasing said first and second rods towards said building boundary comprises first and second first-class levers pivotably mounted to the second housing portion, the first and second first-class levers bearing against said first and second locking plates respectively in order to extend said first and second rods towards the building opening boundary and to lock the first and second locking plates against the first and second rods respectively, such that the first and second rods and locked in place.

20. A safety gate according to claim 19 wherein a portion of the first and second first-class levers extends externally from the first housing portion, each portion being a handle.

21. A safety gate according to claim 1 wherein the curtain is provided with a plurality of generally parallel folds, arranged to predispose the curtain to ford together in a concertina fashion.

22. A safety gate according to claim 1 further comprising a retaining means in the storage housing for receiving said first and second elongate guide tracks when the guide tracks are removed from the socket means.

23. A collapsible safety gate for forming a barrier across an opening inside a building comprising:

an elongate storage housing having first and second separable housing portions, the second housing portion being permanently affixed to a boundary of the building opening;

a folding curtain having first and second ends connected respectively to said first and second housing portions and movable between a collapsed state and an extended state, wherein when in the collapsed state, the first and second housing portions are disposed adjacent to each other and the curtain is disposed in a folded condition within the housing portions, and when in the expanded state, the first and second housing portions are spaced apart such that the curtain forms a barrier across the building opening;

a plurality of coupling means for coupling the curtain to a first and second guide elongate track, the coupling means disposed at intervals along each of two side edges of the flexible curtain;

a socket means connected to each end of said first and second housing portions for receiving at least one curtain coupling means when the curtain is in its collapsed state; and the first and second elongate guide tracks removably connected to said socket means to engage said coupling means when the first and second housing portions are spaced apart, such that said coupling means are slidable along the tracks.

24. A safety gate according to claim 23 wherein each socket means comprises an opening for receiving one of the first and second guide track and a longitudinal slot, and wherein each guide track comprises a longitudinal slot that is vertically aligned with the socket means slot in the first and second housing portions.

25. A safety gate according to claim 24 wherein the slot of the socket means receives at least one coupling means when the curtain is in the collapsed state.

26. A safety gate according to claim 23 wherein each coupling means comprises an end section and each guide track comprises a first longitudinal slot and second slot, wherein the second slots are wider than the first slots and the first and second slots form a channel, each end section extends from the curtain and slidably couples to one of the channels when the first and second housing portions are spaced apart.

27. A safety gate according to claim 26 wherein each coupling means comprises a shaft, the shaft having a first end section and a second end section, such that the first end section of the shaft is slidably coupled to the channel of the first guide track and the second end section of the shaft is slidably connected to the channel of the second guide track when the first and second housing portions are spaced apart.

28. A safety gate according to claim 26 wherein said end sections are supports by a locking key, said locking key being attached to at least one of said first and second guide tracks, and being movable form a position where it does not obstruct movement of said end sections of said coupling means along the guide track to be a position where it does obstruct movement of said end sections of said coupling means along the guide track.

29. A safety gate according to claim 23 wherein the curtain is provided with a plurality of generally parallel folds, arranged to predispose the curtain to fold together in a concertina fashion.

30. A safety gate according to claim 23 further comprising a retaining means in the storage housing for receiving said first and second elongate guide tracks when the guide tracks are removed from the socket means.

* * * * *